United States Patent [19]

Knapp

[11] 4,408,800

[45] Oct. 11, 1983

[54] OFFICE CHAIRS

[75] Inventor: Robert L. Knapp, Grand Rapids, Mich.

[73] Assignee: American Seating Company, Grand Rapids, Mich.

[21] Appl. No.: 158,433

[22] Filed: Jun. 11, 1980

[51] Int. Cl.[3] ..... A47C 3/00; A47C 1/02; A47C 1/022

[52] U.S. Cl. ..... 297/285; 248/631; 297/300; 297/306; 297/347

[58] Field of Search ..... 297/285, 300, 301, 307, 297/347, 71, 306, 361, 358; 251/77, 233, 251, 254; 137/636.1; 248/631

[56] References Cited

U.S. PATENT DOCUMENTS

| | | | |
|---|---|---|---|
| 2,524,624 | 10/1950 | Cramer . | |
| 2,529,683 | 11/1950 | Fox . | |
| 2,579,918 | 12/1951 | Freeman . | |
| 2,796,920 | 6/1957 | Cowels . | |
| 3,288,527 | 11/1966 | Martens . | |
| 3,403,700 | 10/1968 | Meynell | 137/636.1 |
| 3,450,433 | 6/1969 | Ballard . | |
| 3,544,160 | 12/1970 | Karasick . | |
| 3,744,843 | 7/1973 | Barecki . | |
| 3,837,704 | 9/1974 | Bauer . | |
| 3,880,465 | 4/1975 | Scheben | 248/631 |
| 4,157,203 | 6/1979 | Ambasz | 297/354 X |
| 4,200,332 | 4/1980 | Bräuning | 297/300 |
| 4,270,797 | 6/1981 | Bräuning | 297/300 |

FOREIGN PATENT DOCUMENTS

| | | | |
|---|---|---|---|
| 2226838 | 6/1972 | Fed. Rep. of Germany . | |
| 2757349 | 12/1977 | Fed. Rep. of Germany | 248/631 |
| 2646941 | 5/1978 | Fed. Rep. of Germany | 137/636.1 |
| 2706736 | 8/1978 | Fed. Rep. of Germany | 297/300 |
| 2710043 | 9/1978 | Fed. Rep. of Germany | 297/300 |
| 1241452 | 8/1960 | France | 297/285 |
| 1137552 | 12/1968 | United Kingdom | 297/285 |

*Primary Examiner*—James T. McCall

*Attorney, Agent, or Firm*—Emrich, Lee, Brown & Hill

[57] ABSTRACT

Improvements for office chairs are described which include a cam control mechanism having two operative positions under control of the occupant. In the first position the cam actuates a first pneumatic cylinder to adjust the height of the seat over a continuous range. In the second position, the cam independently actuates a second pneumatic cylinder for adjusting the postural attitude of the backrest over a continuous range about a pivot located at the sacral level of the occupant. In the postural adjustment mode, the cam may be positioned to actuate the backrest adjusting cylinder continuously so that the backrest provides a floating support or dynamic cushioning to the back of the occupant. The backrest cushion assembly is mounted to its support by means of a pair of laterally spaced cushion mounts which provide lesser resistance and support to body motions in a fore-and-aft plane but greater support to laterally backward motion, as when the occupant is reaching for something.

8 Claims, 9 Drawing Figures

73
29
28
75
70
95
91
24
25
17
18
35
36
16
39
23
22
19
15
13
12
10
11
11
11

Fig. 2.
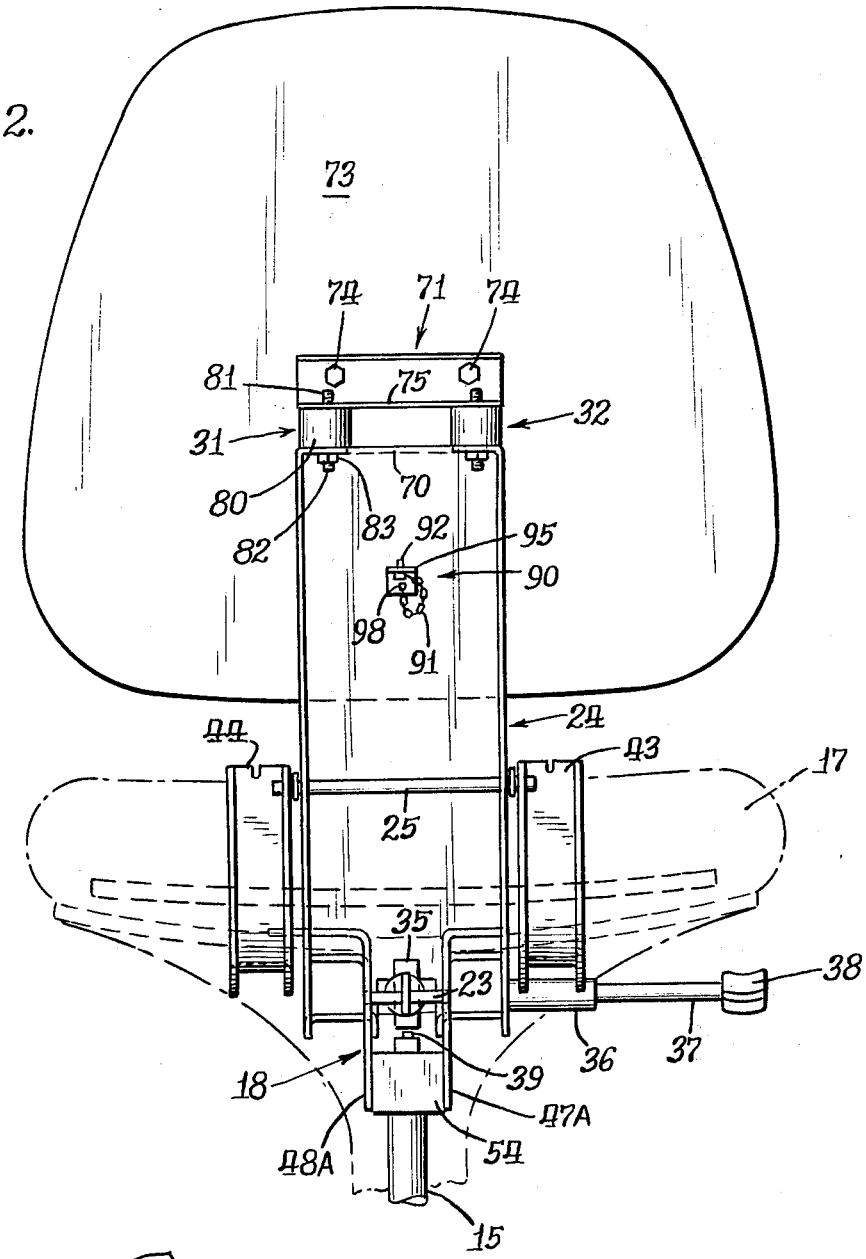
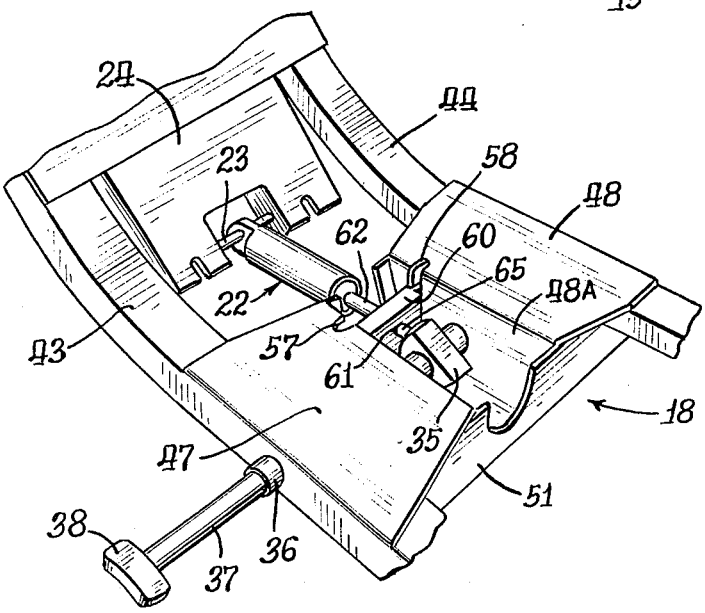
Fig. 3.

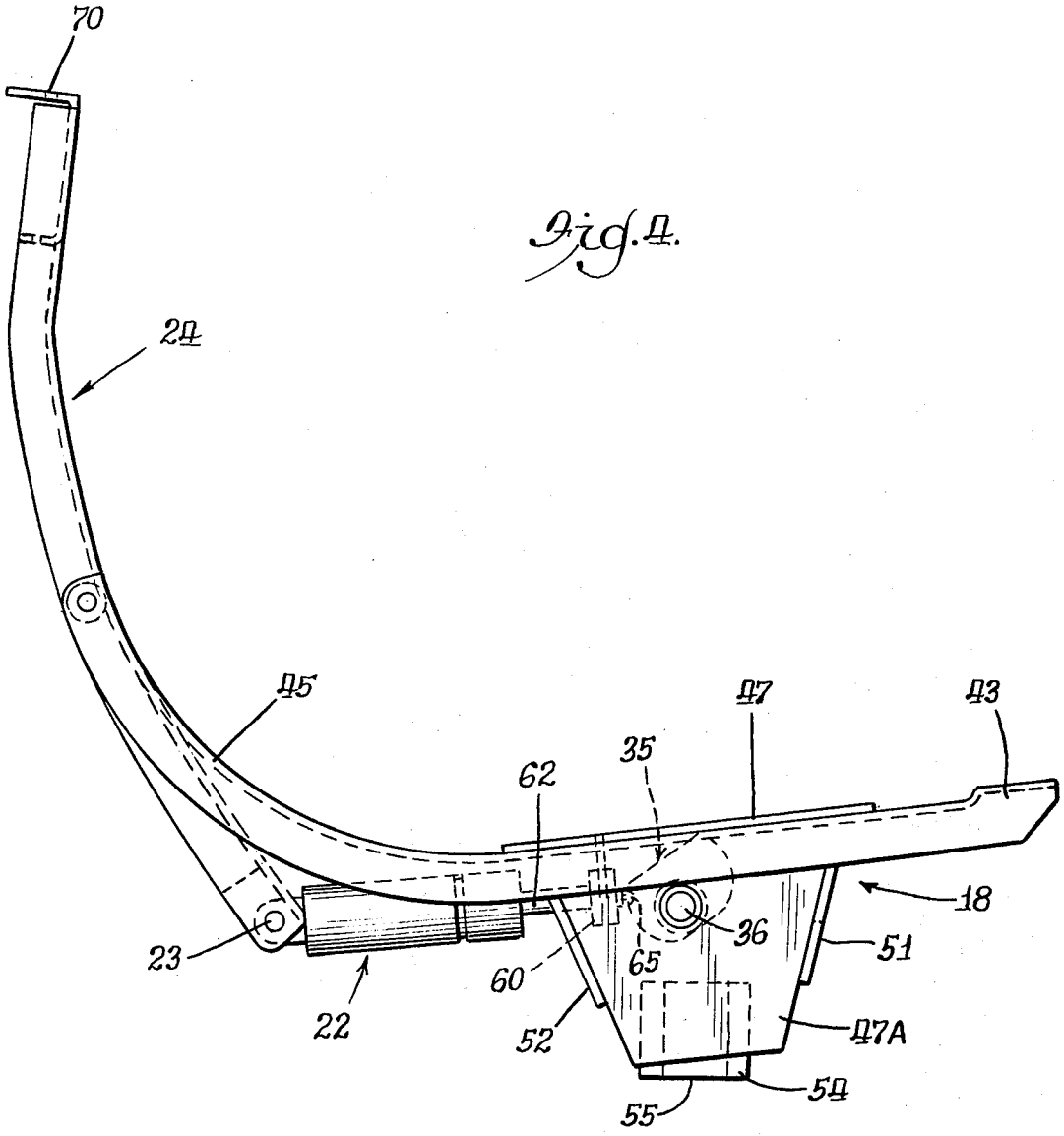
Fig. 4.
Fig. 5.
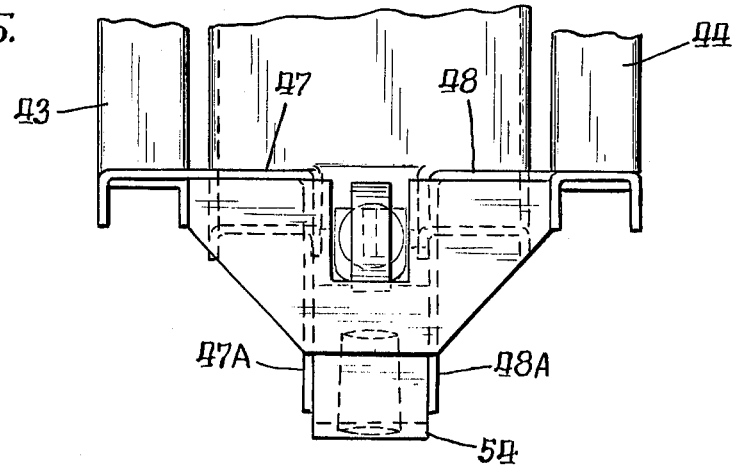

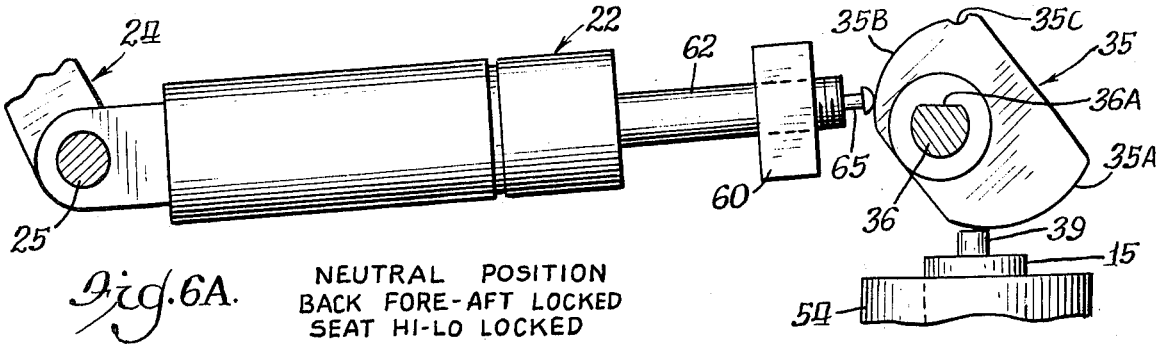
Fig. 6A. NEUTRAL POSITION
BACK FORE-AFT LOCKED
SEAT HI-LO LOCKED
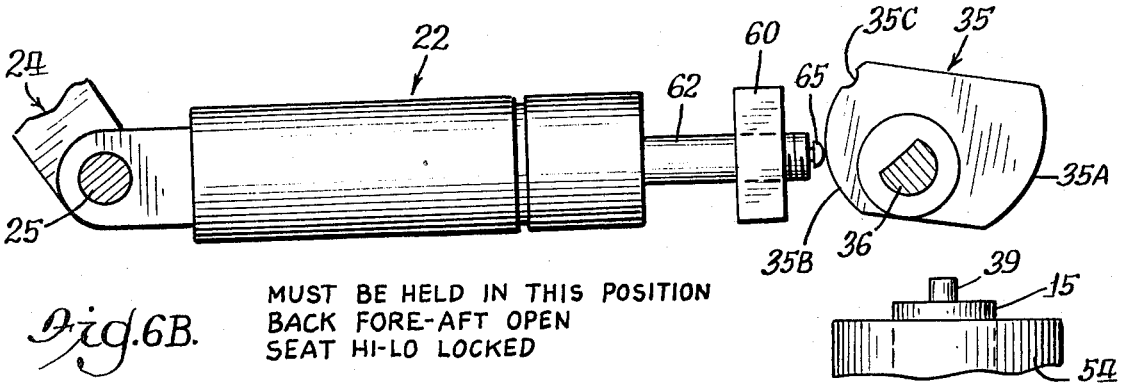
Fig. 6B. MUST BE HELD IN THIS POSITION
BACK FORE-AFT OPEN
SEAT HI-LO LOCKED
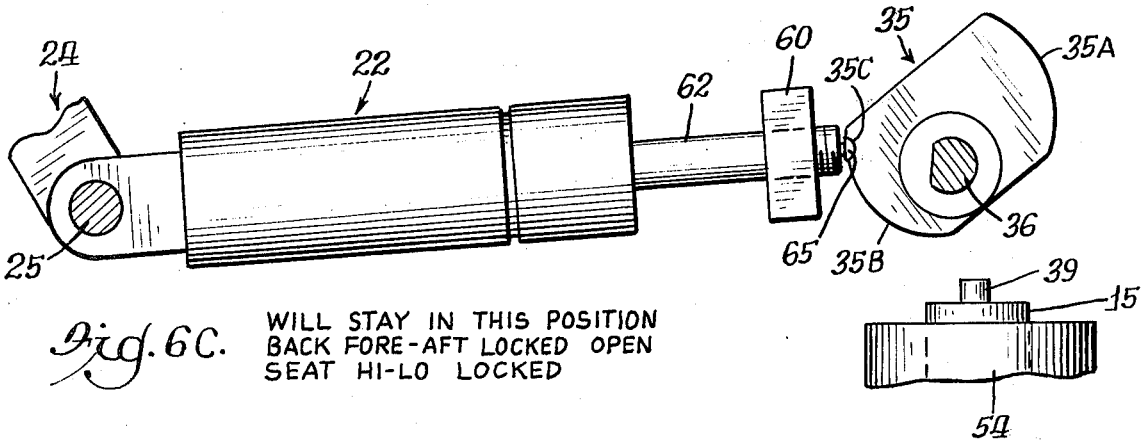
Fig. 6C. WILL STAY IN THIS POSITION
BACK FORE-AFT LOCKED OPEN
SEAT HI-LO LOCKED
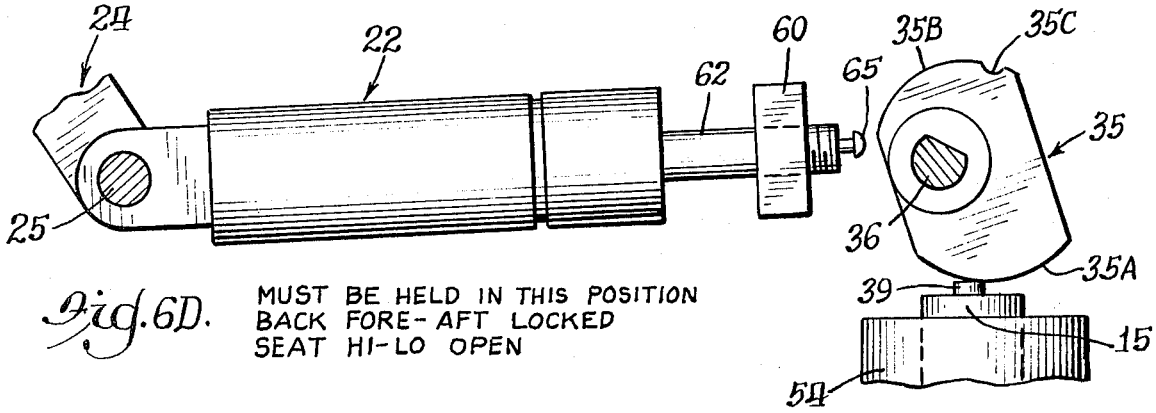
Fig. 6D. MUST BE HELD IN THIS POSITION
BACK FORE-AFT LOCKED
SEAT HI-LO OPEN

OFFICE CHAIRS

BACKGROUND AND SUMMARY

The present invention relates to chairs of the type which are used in offices, such as for secretarial or managerial use wherein a person occupies the chair for extended periods of time and the chair should be designed to provide not only sustained comfort to the occupant but to facilitate the performance of a large variety of tasks and a large number of positions and movements. More specifically, the present invention relates to an office chair in which the seat of the chair is vertically adjustable by means of a pneumatic cylinder and the backrest is independently adjustable for postural attitude. The postural attitude adjustment is also achieved with a pneumatic cylinder. Both cylinders are actuated by the same cam which is mounted to a shaft which extends laterally outwardly beneath the seat and includes a handle to facilitate rotation of the cam shaft by the occupant to the various operating positions.

When the cam shaft is rotated in one direction, a first surface of the cam unlocks a vertically oriented pneumatic cylinder forming a pedestal of the chair so that the seat may be adjusted in height. The vertical pneumatic cylinder is biased in such a way as to offset the weight of the seat, frame and backrest such that when the chair is unoccupied, these elements will rise as a unit. Height adjustment is accomplished by the occupant's using his or her weight to overcome the upward bias on the vertical cylinder. When the seat is in the desired adjusted position, the cam is rotated to the neutral position to lock the vertical cylinder.

The backrest assembly includes a support channel which is pivotally mounted to the rear of the base of the seat near the sacral region of the occupant. The lower end of the back support member is pivotally connected to the back adjusting pneumatic cylinder, and the backrest assembly is mounted to the upper end of the back support member. By rotating the cam shaft in a direction opposite to that which unlocked the height-adjusting vertical pneumatic cylinder, a second cam surface unlocks the back adjusting cylinder to permit the occupant to adjust the backrest in postural attitude about the pivotal connection of the back support member to the rear of the seat base.

This second cam surface which unlocks the backrest adjusting cylinder also includes a detent which may be stably positioned on the valve actuator of the adjusting cylinder for the backrest for continuously actuating or unlocking the backrest cylinder to provide a floating support or dynamic cushioning to the back of the occupant.

The backrest cushion assembly is mounted to its support by means of a pair of laterally spaced cushion mounts which provide lesser resistance to body motion in a fore-and-aft direction and greater support to reaching motions of the occupant in a lateral or rearward direction where such support is desired.

Other features and advantages of the present invention will be apparent to persons skilled in the art from the following detailed description of a preferred embodiment accompanied by the attached drawing wherein identical reference numerals refer to like parts in the various views.

THE DRAWING

FIG. 2 is a fragmentary rear elevational view of the chair of FIG. 1 showing the backrest support and adjusting mechanism;

FIG. 3 is a fragmentary upper perspective view showing the backrest adjusting cylinder and actuating mechanism;

FIG. 4 is a right side elevational view of the structural framework for the seat and backrest of the chair of FIG. 1;

FIG. 5 is a fragmentary front view of the lower portion of FIG. 4 showing the seat assembly support structure; and FIGS. 6A–6D are diagrammatic side views illustrating the various positions of the actuating cam in relation to the adjusting gas cylinders for illustrating the various operating modes of the chair of FIG. 1.

GENERAL DESCRIPTION

Figure 1:
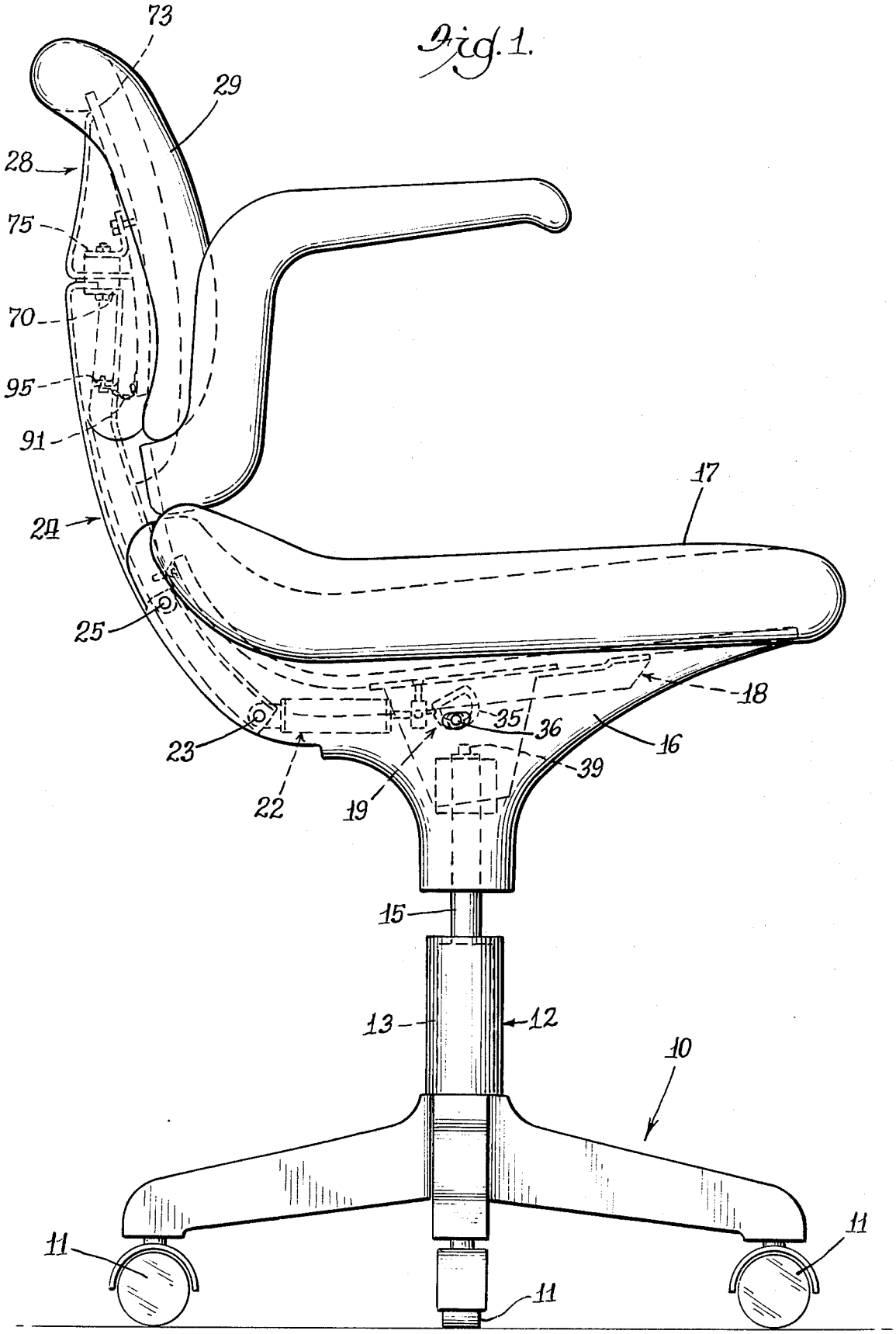
FIG. 1 is a side elevational view of a chair incorporating the present invention.

Referring first to FIG. 1, an office chair is seen to include a base generally designated 10 and provided with casters 11. Preferably the base 10 includes five outwardly extending support arms for greater stability. Above the base 10 is a pneumatic cylindrical unit 12 having its cylinder end press fit into a tapered seat (No. 3 Morris taper) formed in the center of base 10. A rod 15 extends vertically above the unit 12 and is similarly (i.e. No. 3 Morris taper) attached to a seat support frame 18. A sculptured cover or panel 16 houses the seat support structure and a control mechanism generally designated 19.

A second pneumatic cylinder 22 is also located within the seat panel 16 and actuated by the control mechanism 19. The butt end of the cylinder 22 is pivotally connected by a pin 23 to the lower end of a backrest support channel generally designated 24 which is pivotally mounted at 25 to the seat support frame 18, and extends above the seat cushion 17 for supporting the backrest assembly generally designated 28 which includes a backrest cushion 29.

The backrest assembly 28 is mounted to the support member 24 by means of a pair of cushion mounts shown at 31, 32 in FIG. 2, and to be described further below.

Before describing the structure of the chair in more detail, it may be helpful to understand the overall functioning of the major components just described. The control mechanism 19 includes a cam shown in dotted line at 35 in FIG. 1, and it is mounted to a cam shaft 36 which extends outwardly through the seat support frame 18 and is connected to a shank 37 fitted at its outboard end with a handle 38 (see FIG. 2). The handle 38 is located just beneath the side of the seat cushion 17 toward the center (in a fore-and-aft direction) of the seat so that an occupant may conveniently reach down and turn it.

By turning the handle 38 in one direction (clockwise in FIG. 1) the cam 35 is rotated to a first actuating position in which it unlocks the pneumatic cylinder 13 to permit the chair to be adjusted in height. Each of the pneumatic cylinders 13, 22 is similar in structure and operation. These cylinders 13, 22 is similar in structure and operation. These cylinders are commercially available and known in the art. Cylinders of this type are sometimes referred to as "gas cylinders." These pneumatic cylinders include pressurized gas which is trapped within the cylinder and may be communicated between the chamber partially defined by the working face of the piston (that is, the butt end of the cylinder) and the chamber partially defined by the rod surface of the piston (or rod end of the cylinder) by means of a valve located in the piston. The valve is actuated by a stem such as that designated 39 in FIG. 1 for the cylinder 13 which extends through the rod 15 of the cylinder for engagement by the cam 35. When the valve stem is depressed, the valve is opened to communicate the two cylinder chambers with each other. Because the area of the working surface of the piston is larger and the internal pressure is equalized when the valve is open, there is a tendency to extend the rod 15 vertically and thereby elevate the seat assembly, backrest assembly and backrest support structure as a unit. The occupant of the chair may offset this upward force by applying his or her own weight in a seating action if it is desired to lower the seat.

By rotating the handle 38 in the opposite direction (counterclockwise in FIG. 1), the cam 35 actuates the backrest adjusting cylinder 22 to vary the postural attitude of the backrest. This cylinder is biased to urge the backrest assembly 28 to a forward position. At least part of the unbalanced force on the gas cylinders may be offset by a spring if desired. When the backrest adjusting cylinder 22 is thus unlocked, the backrest will have a natural tendency to go forward, and again, this may be offset by the occupant in a normal seated position by simply leaning rearwardly to place the backrest assembly in the desired adjusted position and then lock it in that position by releasing the actuating mechanism. It is considered an advantage of the invention that the pivotal mounting of the backrest support member 24, namely the connection 25 is located behind the sacral area of the occupant so that the backrest cushion provides support to the same general area of the occupant for all adjusted positions. It will also be appreciated that both the height of the seat and the postural attitude of the backrest may be adjusted over a continuous range, rather than in discrete steps.

The cam 35 is also provided with a recess or detent to couple to the valve stem of the backrest adjusting cylinder 22 in a stable position so that the two remain engaged when the operator releases the handle 38. This permits the backrest to "free float" to provide a dynamic cushioning support to the back of the occupant.

To briefly describe the action of the cushion mounts 31, 32 of FIG. 2, they may be bent about a horizontal transverse axis extending perpendicular to the axes of the cushion supports themselves, as when the occupant leans directly backward. In this type of support, such as when the occupant is relaxing, a lesser resistance is given by the mounts 31, 32 because they are placed in a bending mode of deflection. However, if the occupant were, for example, to lean to the right and rear, as in reaching for a telephone or otherwise, he or she will want to return to the upright position. In this mode, the cushion supports are placed in shear (that is, deformed in such a manner that the top of the support is laterally displaced from, but remains parallel to the bottom of the cushion member); and in this situation, the cushion mounts, acting in unison, provide a greater resistance to deflection and thereby a greater support to the occupant, and at least some return force.

Referring now to FIGS. 2 and 3, the seat support frame 18 includes first and second side channels 43, 44 which extend beneath the seat cushion assembly and, toward the rear of it, curve upwardly (see the portion designated 45 for the side channels 43 in FIG. 4). The support member 24 is pivotally mounted to the rear, upper portions of opposing inner flanges of these channels by means of a pin 25, as best seen in FIG. 2.

Returning to FIG. 3, a pair of plates 47, 48 are welded respectively to the channels 43, 44 and extend inwardly toward each other and thence downwardly, the downwardly extending portions being designated 47A and 48A respectively and seen best in FIG. 5. This structure is braced by forward and rear plates 51, 52 which are welded to the depending portions 47A, 47B and also to the opposing inner flanges of the channels 43, 44 (see FIGS. 4 and 5).

A collar 54 is welded to the opposing inner surfaces of the portions 47A, 48A, and it includes a tapered central bore 55 which receives the upper portion of the rod 15 of the pneumatic cylinder 13 in a press fit while permitting the valve stem or actuator 39 to protrude above the top of the collar 54 for engagement by cam 35, as best seen in FIGS. 1 and 2.

Returning to FIG. 3, the downwardly depending portions 47A, 48A of the plates 47, 48 are stamped to provide vertical slots designated 57, 58 respectively for receiving an anchor block 60. The anchor block 60 has a threaded bore at 61 for threadedly receiving the rod 62 of the pneumatic cylinder 22 while permitting the valve actuator 65 to extend through the anchor block 60 for actuation by the cam 35. The butt end of the cylinder 22 is seen to be pivotally connected by the pin 23 to the lower portion of the support 24 for the backrest assembly. The support 24 is in the form of a channel, as best seen in FIG. 2.

As also seen in FIG. 3, the cam 35 is received on the cam shaft 36 and connected to by a flat (see 36A in FIG. 6A). The shaft extends through the right channel frame member 43 and is connected to the shank 37 of the handle 38 by suitable means to transmit torsional forces from the handle to the cam.

Referring now to FIGS. 2 and 4, the upper portion of the backrest support channel 24 is formed into a flange designated 70. An angle member 71 is fastened to the rear panel 73 of the backrest assembly (see FIG. 1) by threaded fasteners 74. The angle bracket 71 includes a lower horizontal flange 75 spaced above the flange 70 of the channel support 24. Each of the cushion mounts 31, 32 is similar so that only one need be described in detail. The cushion mount 31 includes a cylindrical body 80 of natural rubber complying with SAE specification No. J200-3BA625-B13C1221. It is integrally molded with oppositely extended threaded studs 81, 82. Stud 81 is secured to flange 70 by means of a threaded aperture, and stud 82 is secured to flange 70 by a nut 84. Each of the threaded studs has an enlarged or disc-shaped base embedded in the rubber during the molding process so that they do not tear loose from the rubber body during use.

Referring now to FIG. 6A, the cam 35 is seen in a neutral position. It includes a first cam surface 35A and a second cam surface 35B. A recess or detent 35C is formed adjacent the second cam surface 35.

In the position shown in FIG. 6A, the cam 35 does not actuate either valve stem 39 of the vertical adjustment pneumatic cylinder or the valve stem 65 of the postural attitude adjusting cylinder 22.

If the cam 35 is rotated counterclockwise by the handle 38 from the position of FIG. 6A to that of FIG. 6B, the cam surface 35B depresses the valve actuator 65 because the rod 62 is secured in position by the anchor block 60, as described above. In this manner, the postural attitude adjusting cylinder 22 is unlocked so that the backrest support channel 24 may be pivoted about the pin 25 for adjustment purposes. As explained previously, the bias of the cylinder 22 is such that when it is unlocked, it has a tendency to force the backrest assembly to a forward position, and the occupant can then set it at will be applying pressure against it with his back, while holding the handle 38 in the actuated position shown in FIG. 6B.

By rotating the cam still further counterclockwise to the position shown in FIG. 6C, the detent 35C of the cam 35 couples to the valve actuator 65 in a stable position. Thus, the handle need not be continuously held for the cam in this position to continuously actuate the cylinder 22. In this position, the occupant of the chair may continue to work and the backrest will supply a floating support or dynamic cushioning.

With the cam 35 in the positions illustrated in FIGS. 6A, 6B and 6C, the height adjusting cylinder 12 is not actuated. By turning the cam 35 clockwise to the position shown in FIG. 6D, the cam surface 35A depresses the valve actuator 39 to unlock the cylinder 12 for height adjustment. Again, the rod 15 is biased in an upward direction to raise the seat frame and backrest frame as a unit, and height adjustment is accomplished by holding the cam 35 in the position of FIG. 6D while the occupant uses his or her weight to offset the normal upward force of the pneumatic cylinder until the seat is located in the desired vertical position. The handle is then released, and the vertical adjusting cylinder is locked.

Referring back to FIGS. 1 and 2, by locating the pivot pin 25 for the backrest support at a location behind the sacral area of the occupant, as the postural attitude of the backrest assembly is adjusted by means of the cylinder 22, the backrest cushion nevertheless remains in substantially the same position for support of the back of the occupant. For all such postural attitudes, the cushion mounts 31, 32 have the same operation. That is, as the occupant leans directly backward, the cushion members are deflected in a bending mode, and in this mode, they offer little resistance to deflection. The backrest is prevented from being tilted backwardly beyond a limit position by means of a limit position element generally designated by reference numeral 90 in FIG. 2 and including a chain 91 secured by means of a fastener 92 to a tab 94 stamped from the channel support member 24 and bent rearwardly thereof (see FIG. 1), and having its other end fastened at 98 to the panel 73 of the backrest assembly.

On the other hand, if the occupant leans toward the rear and side, the cushion mounts 31, 32 have their associated flexure members placed in a shear mode of deflection which provides greater assistance, and therefore some restoring force to assist the occupant in reassuming a normal occupancy position.

Having thus disclosed in detail a preferred embodiment of the invention, persons skilled in the art will be able to modify certain of the structure which has been illustrated and to substitute equivalent elements for those disclosed while continuing to practice the principle of the invention; and it is, therefore, intended that all such modifications and substitutions be covered as they are embraced within the spirit and scope of the appended claims.

I claim:

1. In an office chair comprising a base adapted to support the chair; seating means including a seat support frame above said base; and a backrest assembly for supporting the back of an occupant of said chair and pivotally mounted to said seat support frame for rotation about a horizontal axis, the improvement comprising: first pneumatic cylinder means interconnecting said seat support frame with said base of said chair for adjusting the height of said seat support frame and including a first actuator valve; second pneumatic cylinder means interconnected between said backrest assembly and said seat support frame for adjusting said backrest in postural attitude and including a second actuator valve; and an actuating mechanism carried by said seat support frame for selectively independently actuating said first and second pneumatic cylinder means and including a cam member mounted in said seat support frame for rotation about a horizontal axis transverse of said chair, a rotatable shaft connected to said cam and journalled in said frame and accessible by said occupant, said cam member having first and second cam surfaces for selectively engaging and actuating said first and second actuator valves of said first and second pneumatic cylinder means respectively when said shaft is rotated respectively in a first angular direction and a second angular direction counter to said first angular direction.

2. The apparatus of claim 1 wherein said cam shaft has a neutral position in which said cam does not actuate either of said valve actuators; and one of said cam surfaces further comprises means for coupling to said valve actuator of said second pneumatic cylinder means in a stable position, whereby said second pneumatic cylinder means remains unlocked and said cam is prevented from returning to said neutral position, and said backrest provides dynamic cushioning for said occupant.

3. The apparatus of claim 2 wherein said coupling means comprises a recess in said cam located such that when said cam shaft is rotated in said counter direction, said second cam surface actuates said second pneumatic cylinder means first and then as said shaft is rotated still further in said counter direction, said recess couples to said valve actuator of said second pneumatic cylinder means in stable relation.

4. In an office chair having a base; seat means supported by said base and a backrest assembly including a backrest support mounted to said seat means and a backrest means, an improved mounting for said backrest means comprising:

first and second cushion mounts for mounting said backrest means to said backrest support, each cushion mount including a body of flexible resilient material and having an axis, said axes of said bodies extending generally vertically and separated laterally relative to said chair, a pair of studs located generally axially of said body and each stud having first and second ends, said first ends extending outwardly of said body in general vertical directions, and said second ends being spaced from one another and attached to said body; and means for securing said first ends of each pair of studs respectively to said backrest support and said backrest means, whereby said bodies are placed in a bending mode of deflection when said backrest means is tilted about a horizontal axis to offer a lesser resistance, and said bodies are placed in shear when said backrest means is rotated about a vertical axis to offer greater resistance to displacement.

5. The apparatus of claim 4 wherein said backrest support includes a first upper horizontal flange and said securing means further includes a second horizontal flange secured to said backrest means and spaced above and extending parallel to said first flange; said first ends of each pair of studs being externally threaded and extending through associated ones of said flanges; and nuts for securing said studs to said associated flanges.

6. The apparatus of claim 4 further comprising means for limiting positively the amount said backrest means may be rotated about a horizontal axis while not limiting its rotation about a vertical axis.

7. An office chair comprising a base adapted to support the chair; seating means including a seat support frame above said base; a backrest assembly for supporting the back of an occupant of said chair and including a support member; means for pivotally attaching said backrest support member to said seat support frame behind the sacral area of an occupant of said chair; first pneumatic cylinder means interconnecting said seat support frame with said base of said chair for adjusting the height of said seat support frame; second pneumatic cylinder means interconnected between said backrest support member and said seat support frame for adjusting said backrest in postural attitude; and an actuating mechanism carried by said seat support frame for selectively independently actuating said first and second pneumatic cylinder means and including a cam member mounted in said seat support frame for rotation about a horizontal axis transverse of said chair, a rotatable shaft connected to said cam and journalled in said frame and accessible by said occupant, said cam member having a first cam surface for selectively engaging and actuating said first pneumatic cylinder means when said shaft is rotated in a first angular direction and a second cam surface for engaging and actuating said second pneumatic cylinder means when said shaft is rotated in a second angular direction counter to said first angular direction; and means for securing the rod end of said second pneumatic cylinder means to said backrest support member comprising an anchor block with an internally threaded bore slidably received in said seat support frame, said seat support frame defining vertically extending slots to receive said anchor block while preventing fore-and-aft motion thereof, the rod of said second pneumatic cylinder means defining external threads received in said internally threaded bore of said anchor block.

8. An office chair comprising: a base adapted to support the chair; seating means including a seat support frame above said base; a backrest assembly for supporting the back of an occupant of said chair and including a backrest support member carrying a backrest and defining a first horizontal flange, means defining a second horizontal flange, means for pivotally connecting said backrest support member to said seat support frame, and first and second cushion mount means interconnecting said first and second horizontal flanges, each cushion mounting means comprising a resilient member defining a generally vertical axis, each of said cushion mount means further including upper and lower studs integrally embedded in each of said cushion members and generally axially aligned with said cushion member and with each other when said cushion members are not being deflected; means for attaching the downwardly extending studs of said cushion mount means to one of said horizontal flanges; and second means for securing the upwardly extending stud members of said cushion mount means to the other of said horizontal flanges; said axes of said resilient members being laterally spaced relative to each other and each resilient member being characterized as being deflected in a bending mode transverse of said axis when said back is rotated about a horizontal axis in a fore-and-aft direction to offer a lesser resistance to displacement, and being deflected in a shear mode when said backrest assembly is twisted about a vertical axis to offer a greater resistance to displacement; means for positively limiting the rotation of said backrest relative to said backrest support member; first pneumatic cylinder means interconnecting said seat support frame with said base of said chair for adjusting the height of said seat support frame and including a first actuator valve; second pneumatic cylinder means interconnected between said backrest assembly and said seat support frame for adjusting said backrest in postural attitude; and an actuating mechanism carried by said seat support frame for selectively independently actuating said first and second pneumatic cylinder means and including a cam member mounted in said seat support frame for rotation about a horizontal axis transverse of said chair, a rotatable shaft connected to said cam and journalled in said frame and accessible by said occupant, said cam member having a first cam surface for selectively engaging and actuating said first pneumatic cylinder means when said shaft is rotated in a first angular direction and a second cam surface for engaging and actuating said second pneumatic cylinder means when said shaft is rotated in a second angular direction counter to said first angular direction.

* * * * *